US005097689A

United States Patent [19]

Pietrobon

[11] Patent Number: 5,097,689

[45] Date of Patent: Mar. 24, 1992

[54] PROCESS FOR MANUFACTURING HOLLOW ONE-PIECE METAL ELEMENTS

[75] Inventor: Tiziana Pietrobon, Lucca, Italy

[73] Assignee: Europa Metalli-LMI S.p.A., Florence, Italy

[21] Appl. No.: 648,823

[22] Filed: Jan. 31, 1991

[30] Foreign Application Priority Data

Feb. 2, 1990 [IT] Italy ..... 67080 A/90

[51] Int. Cl.[5] ..... B21D 26/02

[52] U.S. Cl. ..... 72/58; 72/61; 29/421.1

[58] Field of Search ..... 72/58, 57, 59, 61; 29/421.1

[56] References Cited

U.S. PATENT DOCUMENTS

| | | | |
|---|---|---|---|
| 3,160,130 | 12/1964 | Pesak | 72/56 |
| 3,335,590 | 8/1976 | Early | 72/58 |
| 3,974,675 | 8/1976 | Tominaga | 72/58 |
| 4,437,326 | 3/1984 | Carlson | 72/62 |
| 4,840,053 | 6/1989 | Nakamura | 72/58 |

FOREIGN PATENT DOCUMENTS

| | | | |
|---|---|---|---|
| 601295 | 2/1926 | France . | |
| 19050 | 11/1966 | Japan | 72/58 |
| 259841 | 11/1986 | Japan | 72/58 |
| 199232 | 9/1987 | Japan | 72/58 |
| 1274815 | 12/1986 | U.S.S.R. | 72/58 |
| 2057322 | 4/1981 | United Kingdom . | |

*Primary Examiner*—David Jones
*Attorney, Agent, or Firm*—Michael N. Meller

[57] ABSTRACT

A process for producing hollow one-piece elements having a highly curved lateral wall from metal, in particular copper or copper alloy, pipes. A cylindrical pipe is widened via permanent deformation between two appropriately shaped dies, by simultaneously applying hydraulic pressure directly inside the pipe and axial pressure on the opposite ends of the pipe; the required finished shape being achieved in successive stages, by inserting inside the dies molds having a predetermined profile and of gradually increasing size.

7 Claims, 4 Drawing Sheets

PROCESS FOR MANUFACTURING HOLLOW ONE-PIECE METAL ELEMENTS

BACKGROUND OF THE INVENTION

The present invention relates to a process for manufacturing hollow one-piece metal elements having a highly curved lateral wall, in particular, copper or copper alloy elements for manufacturing the resonating cavities of nuclear accelerators. Here and hereinafter, the term "one-piece element" is intended to mean an element formed in one piece with no joints of any kind. Numerous technical applications, a highly complex one of which is the manufacture of resonating cavities for nuclear accelerators, are known to require hollow elements involving a high degree of precision and surface finish. Resonating cavities, for example, consist of a number of substantially ellipsoidal or paraboloidal cells terminated at opposite ends by cylindrical mouths or "irises" coaxial with the cell axis. At present, each cell is formed from two bowl-shaped half cells drawn from copper or copper alloy sheet and welded together along the maximum diameter line perpendicular to the cell axis through the irises. For ensuring a high degree of dimensional accuracy and optimum surface finish (no blow holes, cracks, inclusions, oxidation, etc.), the two half cells must be welded using fairly sophisticated equipment, e.g. electron-beam or similar, which nonetheless still involves a certain number of rejects. Known methods of manufacturing hollow elements to a high degree of precision and surface finish, and involving electron-beam welding or similar of drawn half cells, therefore involve high production costs; fail to safeguard against manufacturing defects; result in a highly complex production process; and require considerable space, mainly due to the welding equipment employed.

SUMMARY OF THE INVENTION

The aim of the present invention is to provide a process for manufacturing hollow elements of a given shape and optimum precision and surface finish, which is both straightforward and economical and requires very little space for the machinery involved. In particular, the present invention relates to a process for manufacturing hollow, one-piece elements featuring no joints of any kind and therefore requiring no welding. With this aim in view, according to the present invention, there is provided a process for manufacturing hollow, one-piece metal elements, characterized by the fact that it comprises stages consisting in:

placing a cylindrical pipe of given length between two dies designed, when closed in mutually contacting manner, to define a cavity having the same profile as the finished element;

applying a given hydraulic pressure directly inside said pipe length;

applying axial pressure, simultaneously with said hydraulic pressure, on the opposite ends of said pipe length, so as to permanently deform and radially widen the same.

BRIEF DESCRIPTION OF THE DRAWINGS

Two non-limiting embodiments of the present invention will be described by way of examples with reference to the accompanying drawings, in which.

DETAILED DESCRIPTION OF THE INVENTION

Figure 2:
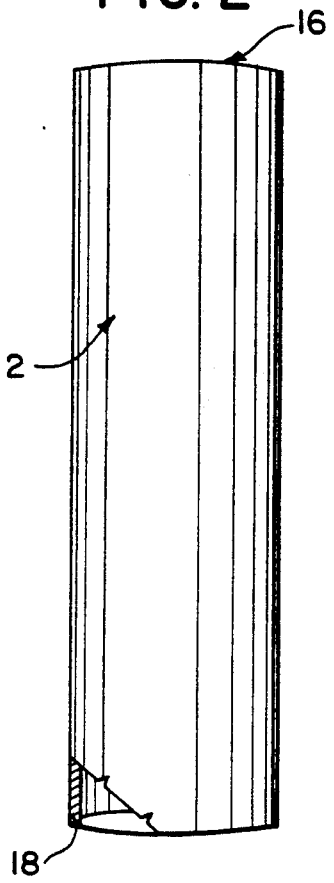
FIG. 2 shows the semifinished part from which the FIG. 1 element is produced.
Figure 1:
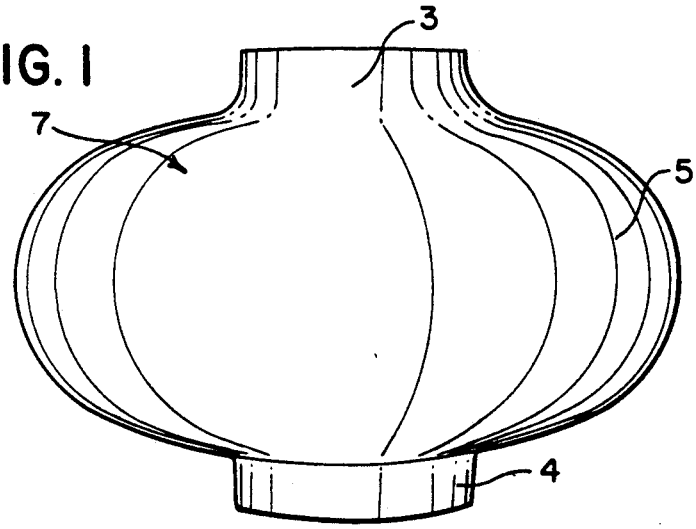
FIG. 1 shows a view in perspective of a hollow one-piece element produced using the process according to the present invention.

With reference to FIGS. 1 and 2, the process according to the present invention provides for producing hollow one-piece elements of any shape and size from given lengths of straight one-piece pipes 2 (i.e. having no joints of any kind) formed, e.g. extruded, rolled or drawn, from metal, in particular copper or copper alloys. The process according to the present invention does not exclude the use of welded pipes providing the surface finish (e.g. subsequent to machining of the pipe) is compatible with the application of the finished hollow element. In particular, the process according to the present invention is described relative to the manufacture of elements 1 consisting of cells for the manufacture of resonating cavities for nuclear accelerators, said cells comprising two opposite, coaxial substantially cylindrical mouths or irises 3 and 4 between which is formed an annular convex portion 5 having a highly curved lateral wall, and in the form of a solid of rotation, e.g. a paraboloid or ellipsoid, the axis of which is that through mouths 3 and 4. The process according to the present invention may, of course, be employed for manufacturing hollow elements of any shape.

Figure 3:
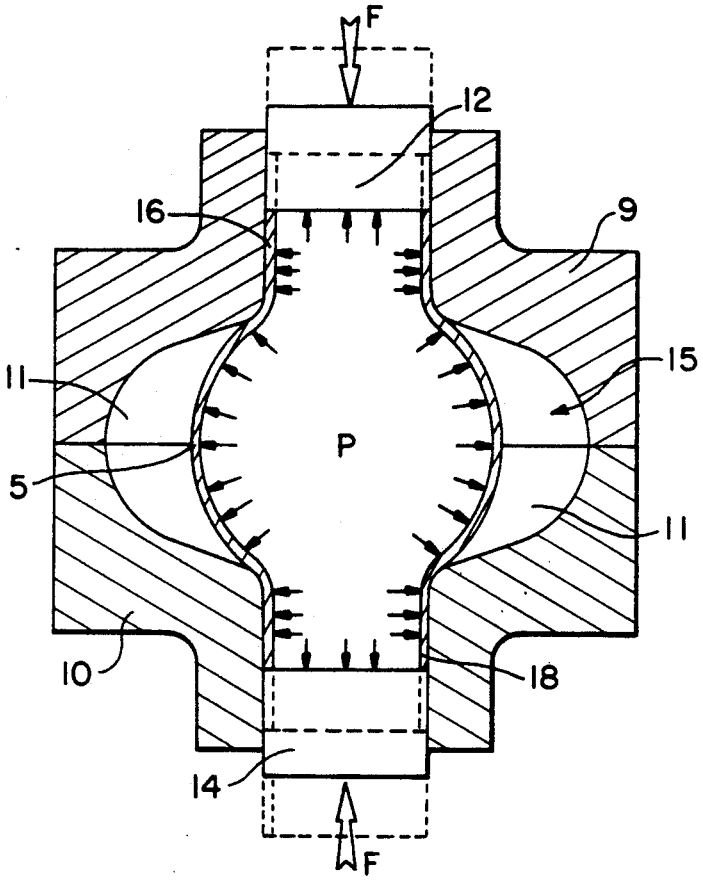
FIG. 3 shows a schematic view of the process according to the present invention.

With reference to FIG. 3, hollow element 1 of given shape is formed from a pipe length 2 (hereinafter referred to simply as "pipe 2") in turn produced by simply cutting to size (and possibly also machining) a commercial pipe, which pipe 2 is permanently deformed so as to widen and consequently shorten it by redistributing the metal of which it is formed. This is done, according to the present invention, using any known type of press (not shown) and a pressurized fluid source of variable pressure P, e.g. a known pump or hydraulic accumulator (not shown), and using the known "hydroforming" technique. Said press presents two dies 9 and 10 arranged facing each other and each housing a given impression 11; and two opposed pistons 12 and 14 arranged, in the example shown, coaxial with each other. Dies 9 and 10 may be closed one on top of the other to define (FIG. 3) an inner cavity 15 formed by adjacent, facing impressions 11 and having substantially the same profile as finished element 1.

According to the present invention, pipe 2 is placed between dies 9 and 10 with its opposite ends 16 and 18 cooperating in fluidtight manner with pistons 12 and 14, which contact ends 16 and 18 and therefore act as respective axial shoulders for pipe 2. A given hydraulic pressure P is then applied inside pipe 2 (e.g. by piping pressurized fluid inside the same) and, at the same time, a given axial pressure F is applied by pistons 12 and 14 on ends 16 and 18 for compressing pipe 2 axially. In FIG. 3, pressure P is shown by the small black arrows, and pressure F by the white arrows. According to a further characteristic of the present invention, pressure F on pistons 12 and 14 is greater than that exerted on pistons 12 and 14 in the opposite direction by hydraulic pressure P inside pipe 2, so that, throughout said forming stage, the axial pressure F on pipe 2 and pressure P inside the same present a predetermined ratio greater than 1 and so selected as to permanently shorten pipe 2.

Pressure P and axial pressure F combine to outwardly "swell" and permanently deform the lateral wall of pipe 2 and so produce convex portion 5. As pressures P and F are increased, convex portion 5 gets bigger and bigger, and pipe 2 is gradually widened until it contacts the inner walls of impressions 11 against which it is pressed so as to exactly reproduce the shape and profile of cavity 15. When pressure P is removed and dies 9 and 10 separated, a hollow one-piece element of exactly the same shape as cavity 15 is produced.

Tests conducted by the Applicant have shown that, using current hydroforming techniques (i.e. only applying pressure P inside pipe 2 between dies 9 and 10), pipe 2 cannot be deformed sufficiently for obtaining the shapes normally required of element 1 without producing premature localized thinning of the lateral wall (pinching) which eventually results in failure of pipe 2 along a generating line. On the other hand, using the process according to the present invention (appropriately combined axial and internal pressure), pipe 2 may be considerably deformed by delaying pinching. According to a further characteristic of the present invention, pipe 2 may be widened approximately 200% (to roughly three times its initial diameter) by permanently deforming it as described above (combined "swelling" and axial pressure) in stages, each stage providing for gradually increasing annular convex portion 5 and, consequently, reducing the axial length of pipe 2.

Figure 5:
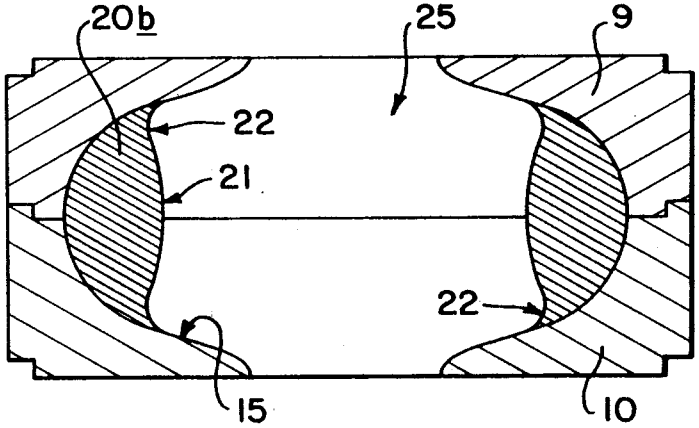
FIGS. 4 to 7 show various stages in the process according to the present invention.
Figure 7:
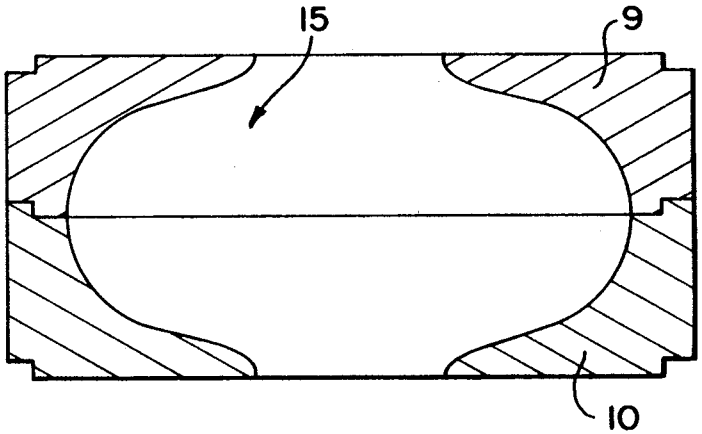
Figure 4:
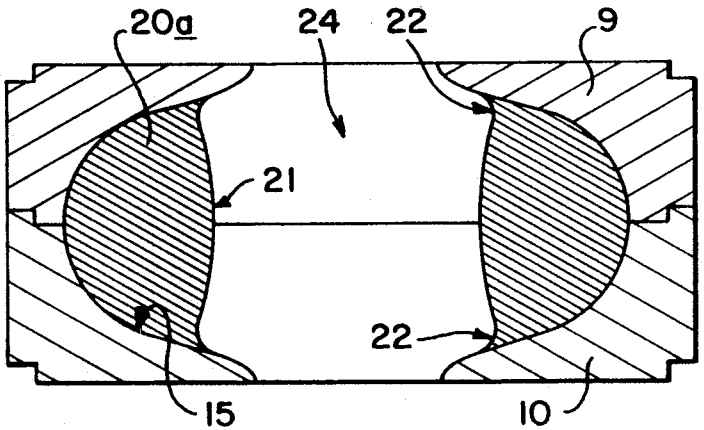
Figure 6:
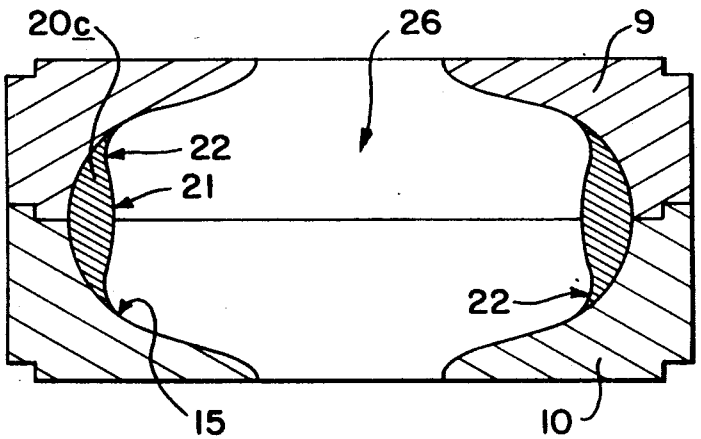

According to the present invention, said stages are performed by simultaneously subjecting pipe 2 to axial pressure F and internal hydraulic pressure P, and by selectively inserting between dies 9 and 10, for guiding and containing deformation of pipe 2, respective annular inserts 20 as shown in FIGS. 4 to 6. In the example shown, these are three in number, 20*a*, 20*b*, 20*c*, and present a given, gradually increasing, curved radial contour against which pipe 2 is partially molded in stages prior to final molding against the walls of dies 9 and 10. Between each partial radial deformation stage and the next, the deformed pipe 2 is subjected in known manner, depending on the material of pipe 2, to recrystallization annealing to eliminate strain hardening and any internal stress produced by cold plastic deformation. Moreover, for minimising the number or partial deformation stages required for obtaining the final shape, i.e. for obtaining, at each stage, the maximum amount of deformation compatible with uniform thickness (and so preventing pipe failure), annular inserts 20 present, along the equatorial line (i.e. in the equatorial plane perpendicular to the axis of symmetry), a convex inner radial profile 21 for forming on pipe 2 radial convex portions 5 having a central annular portion of its lateral wall curving inwards of pipe 2. At opposite axial ends, inserts 20 present a concave inner radial profile 22 adjacent to and blending with convex portion 21. The convex portions 5 formed in pipe 2 at each partial deformation stage therefore present the shape of the cavities defined inside cavity 15 at each stage by inserts 20 and numbered 24, 25 and 26 in FIGS. 4, 5 and 6 respectively.

Figure 8:
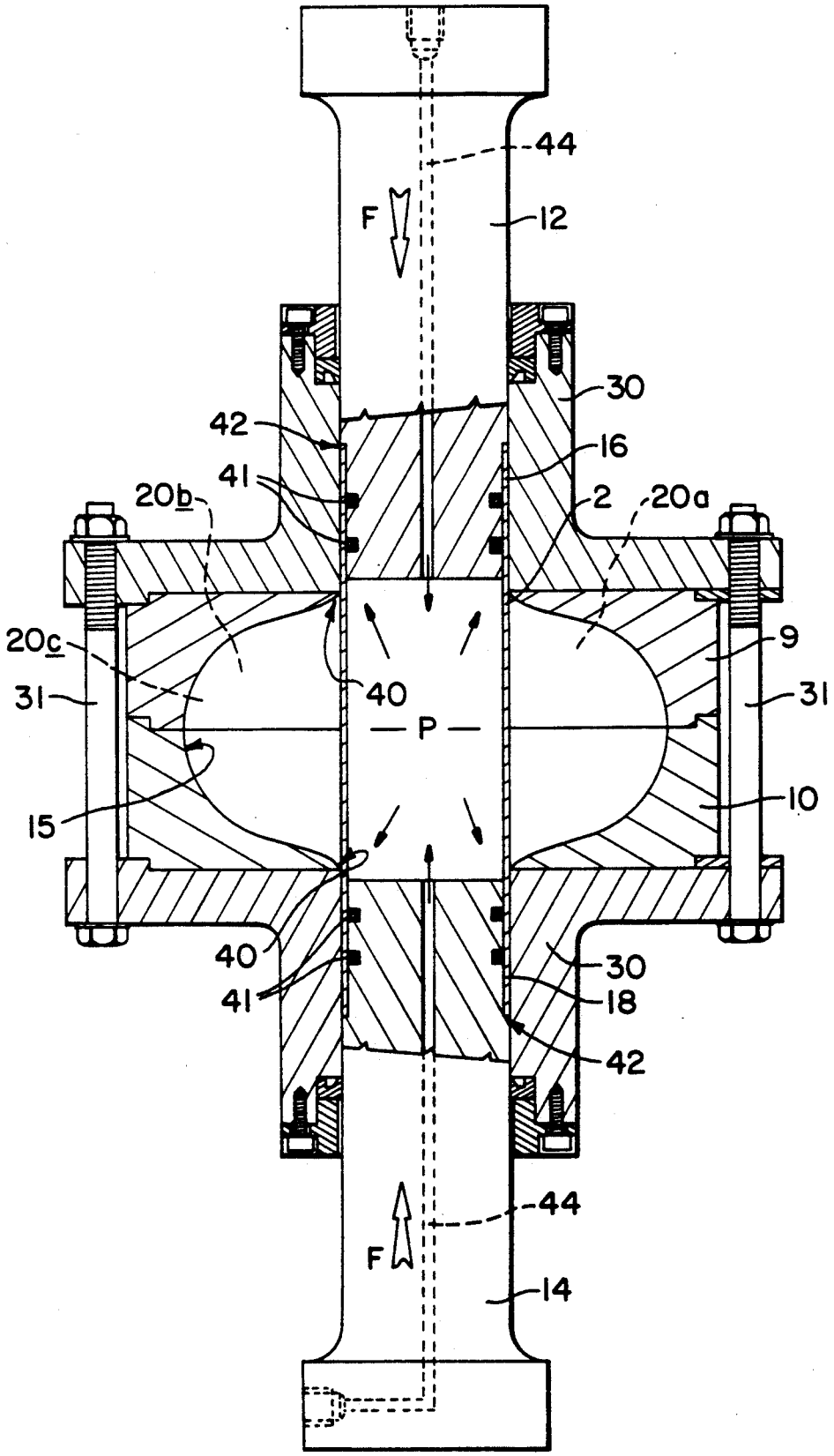
FIG. 8 shows a more detailed view of a first embodiment of the process according to the present invention.

According to a first method shown in detail in FIG. 8, pipe 2 is permanently deformed in stages by placing it between dies 9 and 10 locked one on top of the other and supported on respective elements 30 of said press (not shown) in turn bolted together by bolts 31. The opposite ends 16 and 18 of pipe 2 project from dies 9 and 10 through respective holes 40, and cooperate laterally with respective pistons 12 and 14, inserted inside ends 16 and 18, and externally with elements 30 which also provide for preventing radial enlargement. Pistons 12 and 14 present respective external sealing rings 41 cooperating with the inner surface of ends 16 and 18 for sealing pipe 2 in fluidtight manner. Pistons 12 and 14 also present respective annular shoulders 42 engaged by the edges of ends 16 and 18, and respective through holes 44 defining respective channels by which to feed pressurized fluid inside pipe 2. After inserting inserts 20 inside dies 9 and 10, pipe 2 is deformed by moving pistons 12 and 14 simultaneously towards each other and, at the same time, pumping pressurized fluid, e.g. oil or water, inside pipe 2 through one or both of pistons 12 and 14 (through holes 44), so as to subject pipe 2 simultaneously to the axial pressure F exerted by pistons 12 and 14, and the internal pressure P exerted by the pressurized fluid pumped inside the same. At the first stage, wherein pipe 2 is as yet undeformed and cylindrical in shape, dies 9 and 10 are fitted with insert 20*a* which, at the end of the first stage and after draining off the pressurized fluid inside pipe 2 (e.g. through one or both of holes 44), provides for producing a blank consisting of a shortened pipe 2 having a radial convex portion 5 of the same shape as cavity 24. After being annealed, said blank is subjected in the same way to a second stage, this time using insert 20*b* inside dies 9 and 10. As cavity 25 is wider and presents a different contour as compared with cavity 24, convex portion 5 of pipe 2 is widened further and remolded to reproduce the shape of cavity 25. Finally, after further annealing, a further partial deformation stage using insert 20*c* inside dies 9 and 10, and final annealing, pipe 2, the convex portion 5 of which now presents the same shape as cavity 26, is placed directly between dies 9 and 10 and subjected to a final (fourth) permanent deformation stage wherein only internal pressure P is applied, axial pressure F being maintained at such a level as to counterbalance internal pressure P without shortening pipe 2. At the end of said fourth stage, convex portion 5 presents the same shape as cavity 15, i.e. in the non-limiting example shown, the inward curve of the central portion of convex portion 5 is eliminated (this being made possible by said fourth stage providing for a relatively small amount of deformation as compared with the previous stages). At the end of said fourth stage, therefore, and after cutting to size ends 16 and 18, a hollow element 1 is produced of the required shape and size, with a good surface finish and with no joints.

Figure 9:
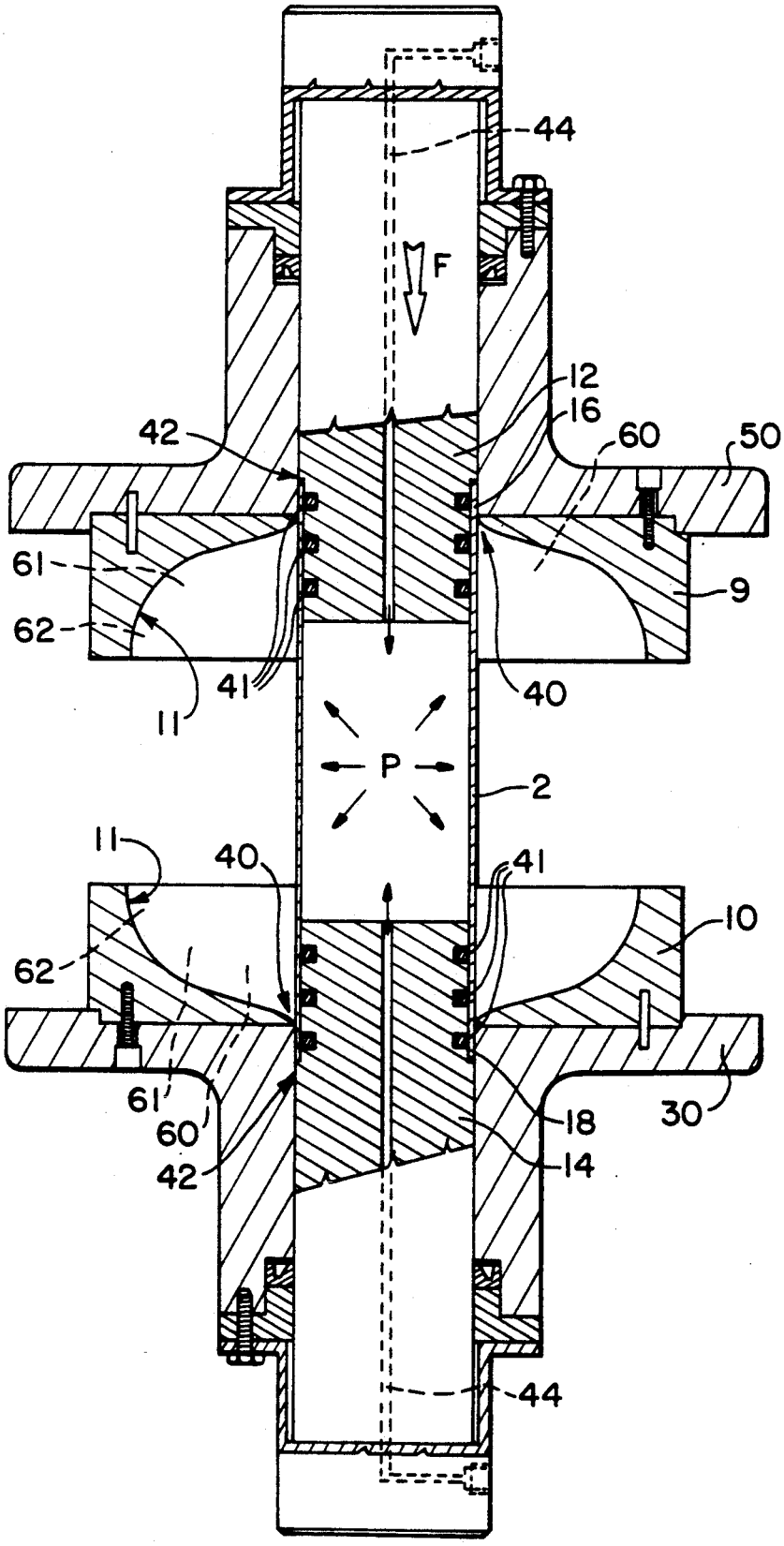
FIG. 9 shows a more detailed view of a second embodiment of the process according to the present invention.

According to a further method, pipe 2 is permanently deformed in stages using the fixture illustrated in FIG. 9, which is substantially similar to the FIG. 8 fixture, and the component parts of which, similar or identical to those in FIG. 8, are shown using the same numbering system. In this case, however, dies 9 and 10 are maintained virtually integral with respective adjacent pistons 12 and 14, and deformation commenced with the dies open. In particular, piston 14 is fixed, presents a channel 44, and supports die 10 integrally via supporting element 30. Piston 12, on the other hand, is axially mobile, presents a second channel 44, and is connected in any known manner (not shown), either mechanically or via a differential control, to die 9 supported on a mobile element 50.

Pipe 2 is placed between open dies 9 and 10 with its opposite ends 16 and 18 inserted in fluidtight manner through holes 40 in dies 9 and 10, and so as to engage axial shoulders 42 on pistons 12 and 14. Ends 16 and 18 cooperate with axial shoulders 42 and sealing rings 41 and, externally with supporting and radial containing elements 30 and 50 which, as in the previous case, prevent radial enlargement of at least part of ends 16 and 18 during permanent deformation of pipe 2, thus ensuring effective sealing on pistons 12 and 14.

According to the FIG. 9 method, inserts 20 are necessarily divided into two annular halves defined by respective annular molds and fitted integrally inside dies 9 and 10, e.g. by means of screws not shown. As shown in FIG. 9, wherein the molds defining inserts 20 are shown by dotted lines, undeformed cylindrical pipe 2 is placed between open dies 9 and 10, and respective annular molds 60 fitted integrally between dies 9 and 10 and about pipe 2. In the example shown, annular molds 60 are symmetrical and so shaped as to define insert 20*a* when mated. With piston 14 and integral die 10 maintained stationary, piston 12 and die 9 are moved together by the same amount and at the same speed towards piston 14 and die 10, while at the same time pressurized fluid, again water or oil, is pumped inside pipe 2 through at least one of pistons 12 or 14 (along channel 44). This results in deformation of pipe 2, the central portion of which not enclosed by dies 9 and 10 begins to "swell", and, at the same time, in gradual closure of dies 9 and 10. As dies 9 and 10 are brought together, pipe 2 continues swelling until it eventually contact molds 60 by which it is gradually molded as piston 12 moves down. When piston 12 stops, i.e. when maximum pressure is reached inside pipe 2, this is enclosed inside a cavity having the same shape as cavity 24 and defined by mated molds 60, and presents a convex portion 5 produced by the combined swelling action of the axial pressure exerted by pistons 12 and 14 (through only piston 12 is operated, the same pressure F is also exerted in the opposite direction by piston 14) and the internal pressure P exerted by the fluid pumped into pipe 2. Convex portion 5 therefore presents the shape of cavity 24 in exactly the same way as if pipe 2 has been deformed between closed dies as in the previous method. The resulting blank is then annealed and subjected to a further two permanent deformation and intermediate annealing stages, again commencing with the dies open, as described above, but this time using molds 61 for the second stage and molds 62 for the third, which molds 61 and 62 are so shaped as to respectively define, when mated, inserts 20*b* and 20*c*, for producing a convex portion 5 having the same shape as cavity 25 in stage two and cavity 26 in stage three. Finally, after removing molds 62, pipe 2 is placed directly between closed dies 9 and 10, and pressurized fluid is pumped inside pipe 2 to produce a convex portion 5 having the same shape as cavity 15 defined by closed dies 9 and 10 and, therefore, a finished hollow element 1 of the required shape and size.

For best results using pipes 2 of extremely pure, high quality copper, e.g. ETP, DLP, DHP, OF or similar, and regardless of which of the aforementioned methods is employed, the aforementioned stages should be performed in such a manner as to widen pipe 2 as follows: 45% in the first stage using inserts 20; 35% in the second stage using inserts 20; 23% in the third stage using inserts 20; and 25% in the fourth or final stage with no inserts 20 and no axial pressure.

The advantages of the process according to the present invention will be clear from the foregoing description. In particular, it provides for permanently deforming pipes into one-piece hollow elements which could only otherwise be produced at the risk of damaging the pipe, as well as for obtaining a high degree of deformation (roughly 200%) for producing hollow elements with highly curved lateral walls.

Using the process according to the present invention, i.e. using inserts having a convex profile along the equatorial line for the intermediate stages, the above result is achieved in a fairly small number of stages (three to four), thus reducing manufacturing time and providing for a good surface finish. Using current hydroforming methods, on the other hand, comparable deformation would require numerous intermediate stages (six to eight), thus resulting in poor surface finish, higher production cost and increased cycle time, further aggravated by the necessity to anneal the semifinished part at each stage.

Whereas the FIG. 8 method requires a special press with two opposed sliding pistons, the further improved method shown in FIG. 9 provides for implementing the process according to the present invention using standard, single-piston press, and is therefore preferable for economic reasons. What is more, the FIG. 8 method would nevertheless require inserts 20 formed in two parts, i.e. by joining annular molds such as 60, 61 and 62, for removing the finished part from the dies.

To those skilled in the art it will be clear that changes may be made to the process as decribed and illustrated herein without, however, departing from the scope of the present invention. For example, for technical reasons, inserts 20, i.e. molds 60, 61 and 62, may be formed in one piece with dies 9 and 10, in which case, several pairs of dies 9 and 10, each featuring a different insert, will be selectively mounted on the press.

I claim:

1. A process for manufacturing hollow, one-piece metal elements comprising the following steps:

placing cylindrical pipe of given length and having opposite ends between two dies designed, when closed in mutually contacting manner, to define a cavity having the same profile as said finished element;

applying a given hydraulic pressure directly inside said pipe;

applying axial pressure simultaneously with said hydraulic pressure on said opposite ends of said pipe, so as to permanently deform and radially widen the same, said axial pressure being applied by means of a pair of opposed pistons sealing in fluidtight manner, and resting on, said opposite ends of said pipe; said pistons being thrust towards each other at such a pressure as to permanently shorten said pipe, gradually widening said pipe to the size and shape of said hollow element via a first series of gradually increasing deformations for forming on said pipe a gradually increasing radial annular convex portion, by selectively placing between said dies, inserts having a curved radial profile of given shape and gradually increasing size molding said pipe against said inserts by the application of said internal hydraulic pressure and said axial pressure for producing a blank of gradually decreasing length; and finally deforming said blank to the size and shape of said hollow element by inserting it directly, without said inserts, between said dies, and by deforming it against said dies by applying only said internal hydraulic pressure, the axial pressure exerted on said pistons being sufficient solely for balancing said internal hydraulic pressure.

2. A process as claimed in claim 1, including the step of annealing of said pipe between successive radial deformations by said inserts.

3. A process as claimed in claim 1, wherein said inserts are annular inserts having an equatorial line and said pipe has a lateral wall with a central portion, said annular inserts having a convex radial profile on said equatorial line, for forming, on said pipe, radial convex portions said central portion of said lateral wall of which curves inwards of said pipe (2).

4. A process as claimed in claim 1, wherein said successive, gradually increasing deformation stages are performed by placing said pipe between said dies, locked one on top of the other, with said opposite ends of said pipe projecting from said dies and cooperating with said pistons; moving said pistons simultaneously towards each other; and pumping pressurized fluid through at least one of said pistons into said pipe.

5. A process as claimed in claim 1, wherein said successive gradually increasing deformation stages are performed by placing said pipe between said dies in the open position, with said opposite ends of said pipe cooperating with said pistons; maintaining stationary a first of said pistons and a first of said dies integral with the same; simultneously moving a second of said pistons and a second of said dies by the same amount towards said first piston, so as to gradually close said dies; and pumping pressurized fluid through at least one of said pistons into said pipe, simultaneously with displacement of said second piston and said second die.

6. A process as claimed in claim 4, wherein in said first series of deformations, an annular mold defining half of a respective insert, fitted integrally inside each said die and about said pipe.

7. A process as claimed in claim 1, wherein said pipe is made of extremely pure copper; and said pipe is subjected to three successive permanent deformations using said inserts and performed in such a manner as to widen said pipe respectively by 45%, 35% and 23%, and to a final permanent deformation stage involving no inserts and providing for widening said blank by 25%.

* * * * *